US005480201A

United States Patent [19]

Mercer

[11] Patent Number: 5,480,201

[45] Date of Patent: Jan. 2, 1996

[54] SAFETY PIPE HANDLER

[76] Inventor: George L. Mercer, Box 11, 101 Concho Trail, Ft. Worth, Tex. 76108

[21] Appl. No.: 387,342

[22] Filed: Feb. 13, 1995

[51] Int. Cl.[6] ..... B66C 1/28

[52] U.S. Cl. ..... 294/67.31; 294/81.51; 294/81.56; 294/111

[58] Field of Search ..... 294/67.1, 67.3, 294/67.31, 67.5, 81.1–81.51, 81.56, 81.61, 82.1–82.13, 68.3, 74, 106, 111, 112

[56] References Cited

U.S. PATENT DOCUMENTS

| | | | |
|---|---|---|---|
| 1,781,943 | 11/1930 | Bartholomew | 294/67.31 |
| 1,834,499 | 12/1931 | Richter | 294/67.31 |
| 2,617,677 | 11/1952 | Pridy | 294/82.12 X |
| 3,115,361 | 12/1963 | Miles | 294/67.31 X |
| 3,220,761 | 11/1965 | Himel | 294/81.56 |
| 3,606,441 | 9/1971 | Ridgely | 294/82.13 |
| 3,837,698 | 9/1974 | Foster | 294/81.56 |
| 4,084,706 | 4/1978 | Russell | 294/111 X |

FOREIGN PATENT DOCUMENTS

| | | | |
|---|---|---|---|
| 2325689 | 12/1973 | Germany | 294/81.56 |

*Primary Examiner*—Johnny D. Cherry
*Attorney, Agent, or Firm*—Macdonald J. Wiggins

[57] ABSTRACT

A pipe handler for safely handling large pipes utilized in gas and oil lines, and the like utilizes a horizontal spreader bar having a dependent lifting arm hingedly attached at each end thereof. Each of the distal ends of the lifting arms includes a pivoted lifting shoe. The spreader bar is to be suspended from a crane. A winch having a double drum is mounted to the spreader bar and powered by an electric motor. Each drum includes a cable operatively connected to a respective one of the lifting arms. Initial operation of the winch causes the arms to swing outwardly. To handle a large pipe, the crane operator positions the spreader bar over a pipe to be moved, and operates the winch to swing the lifting arms outwardly sufficiently to allow the lifting shoes to thereafter swing inwardly to insert the lifting shoes into the respective ends of the pipe. The pipe can then be hoisted and moved to a desired point.

7 Claims, 3 Drawing Sheets

SAFETY PIPE HANDLER

FIELD OF THE INVENTION

The present invention relates to pipe handlers, and more specifically to a pipe handler for off-loading large steel pipes and the like from a carrier and depositing the pipes on the ground without danger to handling personnel and without damage to the pipes.

DESCRIPTION OF THE PRIOR ART

In laying of pipelines for gas, oil and the like, large steel pipes are utilized. Such pipes are typically 40 to 80 feet in length and vary in diameter from 8 to 48 inches. The pipes include mating bevels to provide a leakproof joint, and the exterior surfaces are coated with a special epoxy material. Since such pipes are very expensive, costing thousands of dollars for each length, great care must be exercised in handling to prevent any damage to the joints or the exterior coatings.

The current method of delivering such pipes to the point of use utilizes rail cars. To provide a means for unloading the pipes from the carrier, a crane supports a spreader bar having steel cables hanging from each end thereof. Each hanging cable has a lifting shoe at its distal end matching the inside diameter of a pipe. Typically, the spreader bar may have a length of 30–35 feet and each hanging steel cable a length of about 30 feet. A handling line is attached to each J-hook. This prior art apparatus is illustrated in FIG. 6.

To unload a pipe using the apparatus of FIG. 6, two men are required on the rail car and two men on the ground. Assuming that the workers on the rail car have caught the depending lifting shoes, each man inserts a lifting shoe into an end of the pipe to be unloaded. The crane operator then raises the pipe, and the men on the ground utilize the handling lines to guide the pipe to the proper location. After the pipe is deposited, the ground crew removes the lifting shoes from the pipe and the crane operator shortens his cable to return the hooks to the crew on the rail car. As will be recognized, the lifting shoes will swing and the men on the rail car must snag the lifting shoes from the air to prevent the swinging shoes from contacting and damaging the pipe coating. Accidents with injuries occur during this phase of the operation since the men on the rail car must stand on the pipes, many times being high off the ground and in precarious positions.

Lifting devices are well known in the art. For example, the following U.S. patents disclose devices for lifting and moving cargo:

Bartholomew U.S. Pat. No. 1,781,943: handling cross ties; McIlvried U.S. Pat. No. 1,822,629: box lifting device; Galliher U.S. Pat. No. 2,035,311: work suspending and transporting carrier; Anderson U.S. Pat. No. 2,721,757: cargo sling; Hall U.S. Pat No. 3,788,694: handling stacks of articles.

A tube handling device is shown by Kishimoto et al. in U.S. Pat. No. 4,563,031 for handling a plurality of small tubes using a telescoping beam and claws for engaging the tubes.

SUMMARY OF THE INVENTION

The present invention utilizes a spreader bar having means for suspension from a crane hook to maintain the bar essentially horizontal. A respective dependent arm formed from tubular steel is pivotally attached to each end of the bar. The distal end of each arm includes an interchangeable lifting shoe having a pipe engaging and lifting shoe element.

The shoe element has a curvature corresponding to the curvature of the inner circumference of the pipe to be handled. An arm lifting bracket extends laterally outward from a lower portion of each arm.

A two-cable winch is mounted at the center of the spreader bar having a first cable passing over a pulley at a first end of the spreader bar and attached to the arm lifting bracket of the first arm, and a second cable passing over a pulley at a second end of the spreader bar and attached to the arm lifting bracket of the second arm. The winch is preferably electrically operated.

To lift a pipe from a rail car, the crane operator swings the spreader bar over the pipe to be lifted, The crane operator controls the winch which swings the arms outward from their vertical position to essentially match the length of the pipe to be lifted. The men on the rail car manually center the arms over the pipe and guide the lifting shoes into the pipe. The winch is adjusted to maintain the hooks securely engaged with the pipe.

At this point, the men stand clear and the crane operator lifts the pipe clear and deposits the pipe on the ground. The winch is operated to swing the arms outward, disengaging the lifting shoes from the pipe without requiring workers on the ground.

As will now be recognized, the invention provides an apparatus and method for safely engaging a pipe to be unloaded by eliminating the prior art swinging cable hooks and by providing positive control by use of tubular arms. Further, labor costs are reduced by elimination of a ground crew and reduction in time of unloading. Additionally, danger to the rail car crew is greatly reduced since the swinging cables are eliminated.

It is therefore a principal object of the invention to provide an apparatus and method for safely off-loading large pipes used for transmission of gas, oil and the like from rail cars without damage to the pipes and reduction of accidents.

It is another object of the invention to provide a handler for off-loading large pipes from rail cars that requires a minimum number of workers.

It is yet another object of the invention to provide a handler for off-loading large pipes from rail cars that will handle a range of pipe lengths.

These, and other objects of the invention will be apparent from the following detailed description when read in conjunction with the drawings.

DETAILED DESCRIPTION OF THE PREFERRED EMBODIMENT

Figure 1:
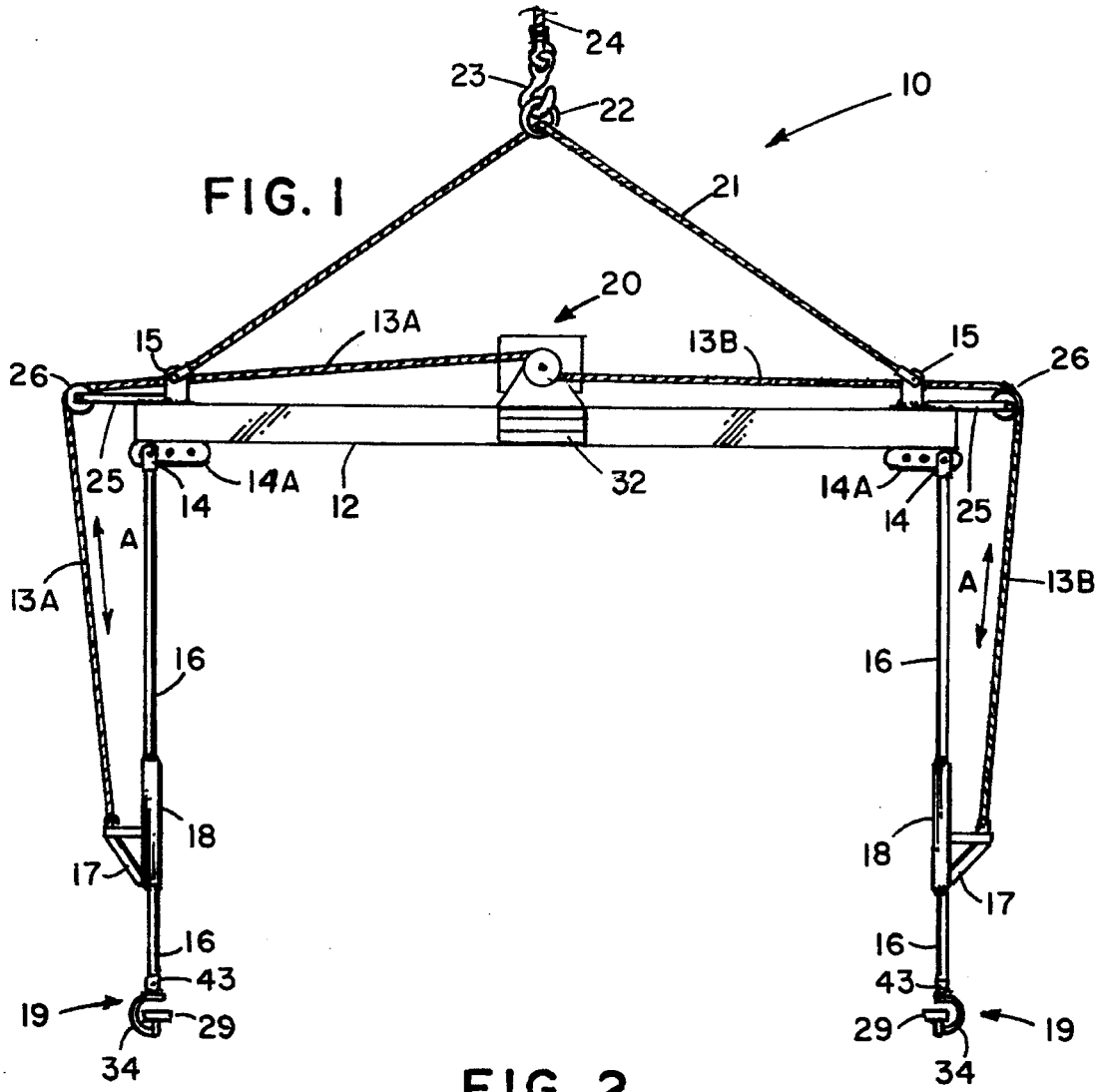
FIG. 1 is a view of the pipe handler of the invention shown in an unoperated condition.

With reference to FIG. 1, a non-operated view of the pipe handler of the invention is shown. A spreader bar 12 is formed of structural steel of sufficient strength to support the weight of large pipes commonly used for gas and oil distribution mains. A pair of support eyes 15 is mounted to spreader bar 12 adjacent the respective ends thereof. A spreader bar support cable 21 is attached to eyes 15, and includes a lifting eye 22. A pulley arm 25 is attached at each end of the spreader bar 25 and extends therefrom, each arm having a pulley 26 at its outer end.

A pair of lifting arms 16 is pivotally attached by clevises 14 to and depend from brackets 14A attached underneath and at each end of spreader bar 12. Brackets 14A include several pivot holes to permit the spacing of lifting arms 16 to be adjusted when desired. Lifting arms 16 are preferably formed from seamless tubing and have sufficient strength to support the expected loads as will be described. Reinforcing tubes 18 are attached toward the distal ends of arms 16, and include lifting brackets 17 projecting outward therefrom.

Figure 2:
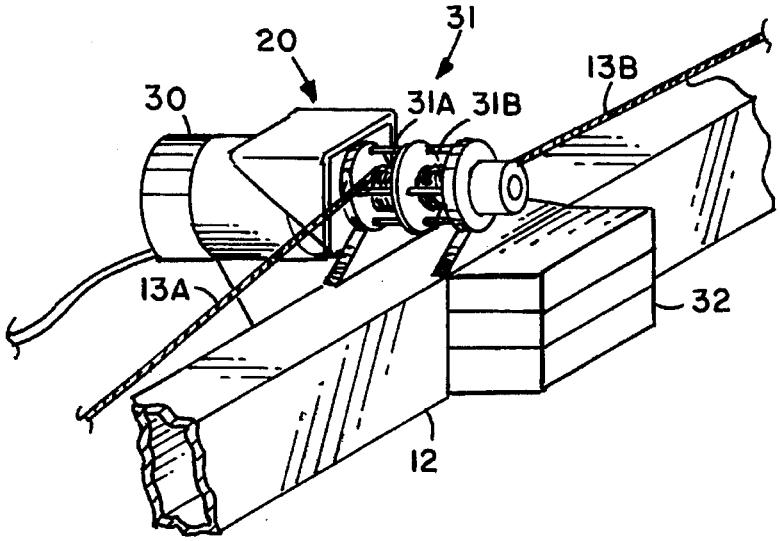
FIG. 2 is a partial view of spreader beam of the invention showing a two-cable winch utilized to operate the lifting arms of the pipe handler.

A two-line winch assembly 20, having an electric motor assembly 30 and a pair of cable drums 31, is mounted in the center and on top of spreader bar 12 as shown in FIG. 2. A counterweight 32 is attached to a face of spreader bar 12 to balance the weight of motor assembly 20. Cable 13A passes over the left pulley 26 from cable drum 31A, and cable 13B passes over the right pulley 26 from cable drum 31B. In FIG. 1, it may be noted that cables 13 are threaded onto cable drums 31 such that the cables 13 wind and unwind together. Thus, when motor 30 is energized, cables 13 are retracted as indicated by arrows A, and arms 16 are caused to swing outward as indicated by arrows B. Reversing motor 30 permits arms 16 to return toward the unoperated position. Winch 20 is preferably driven by an electric motor that can be fed from electrical cables (not shown) connected to the crane cab, or may utilize batteries attached to spreader bar 12 and the motor operated by radio control.

Figure 3:
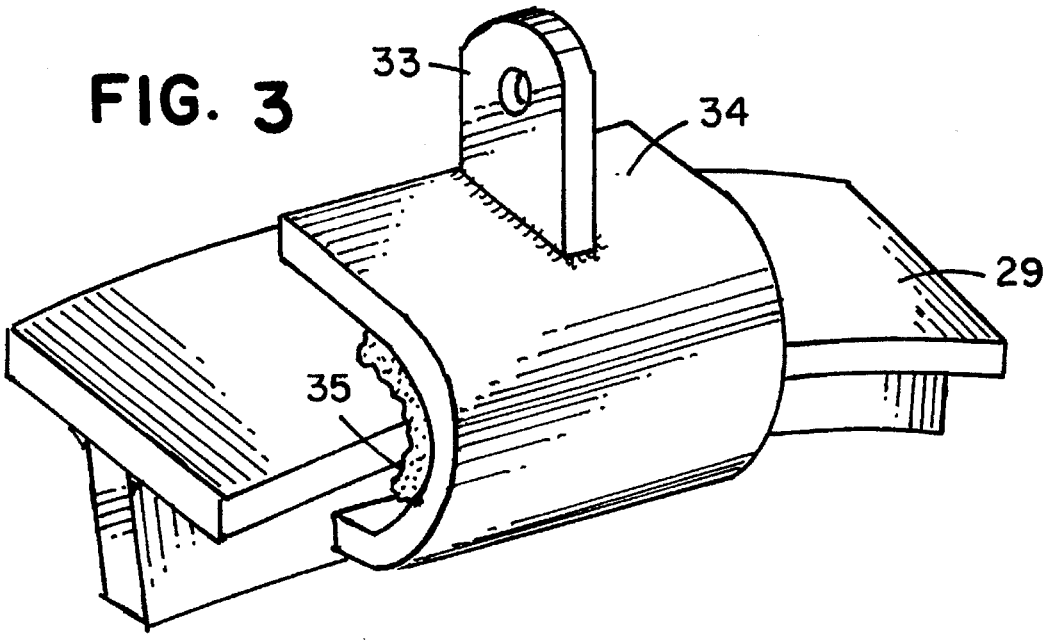
FIG. 3 is a detailed view of a typical lifting shoe of the invention used to couple to a pipe.
Figure 4:
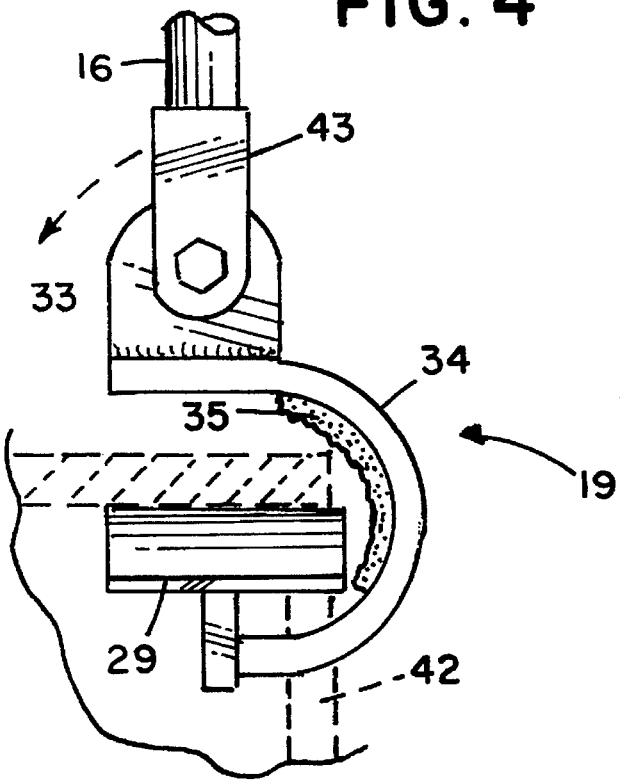
FIG. 4 is a side view of the lifting shoe of FIG. 3 showing a portion of a pipe in phantom view.

At the distal end of each lift arm tube 16, a lifting shoe 19 is provided, shown in perspective view in FIG. 3. Shoe 19 includes shoe element 29 having an arcuate surface that matches the inside curvature of the pipe to be lifted. Shoe element 29 is supported by hook element 34 and support bracket 33. The inner surface of hook element 34 includes a protective liner 35 of rubber or the like. During lifting of a pipe, lifting shoe element 29 is inserted into an end of the pipe 42 as illustrated in FIG. 4. Lifting shoe 29 contacts, mates with, and supports the inner surface of pipe 42. Protective liner 35 prevents any chipping or deformation of the mating surfaces of pipe 42 that could result in leaks when the pipe is installed. Bracket 33 is pivotally attached to shackle 43 at the distal end of lift arm tube 16, permitting lifting hook 19 to pivot, as shown by arrow C, and remain in contact with pipe 42 as the tube is lifted. It is to be understood that sets of lifting shoes 19 will be provided having shoe curvatures to match the inner curvatures of pipes to be handled, and the shoes changed as required.

Figure 5:
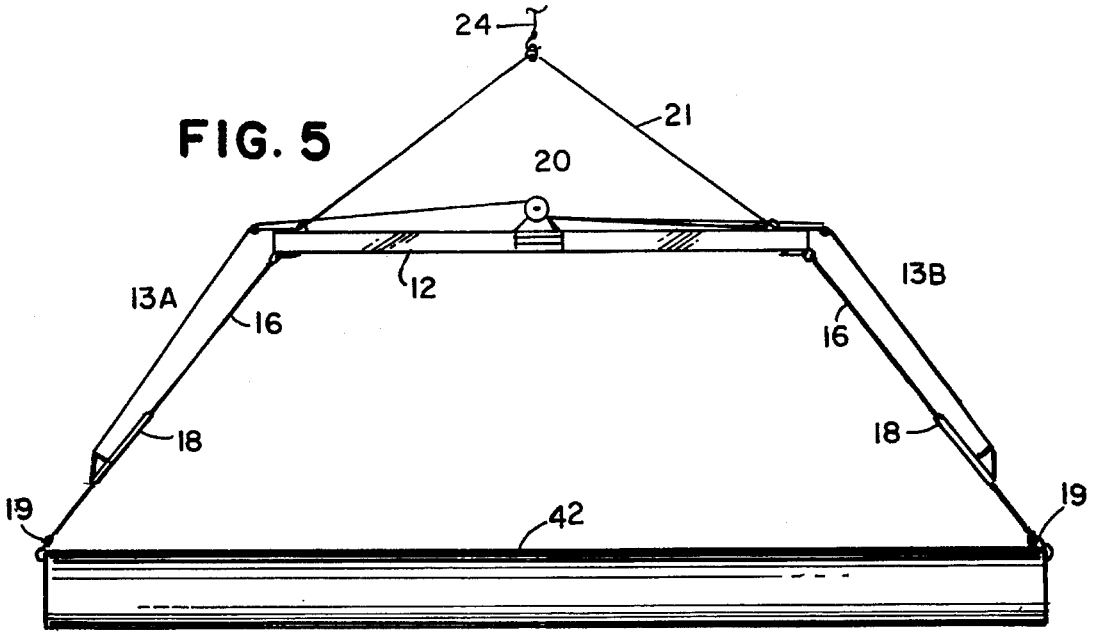
FIG. 5 is a representation of the pipe handler of the invention lifting a typical pipe for off-loading or moving of the pipe.
Figure 6:
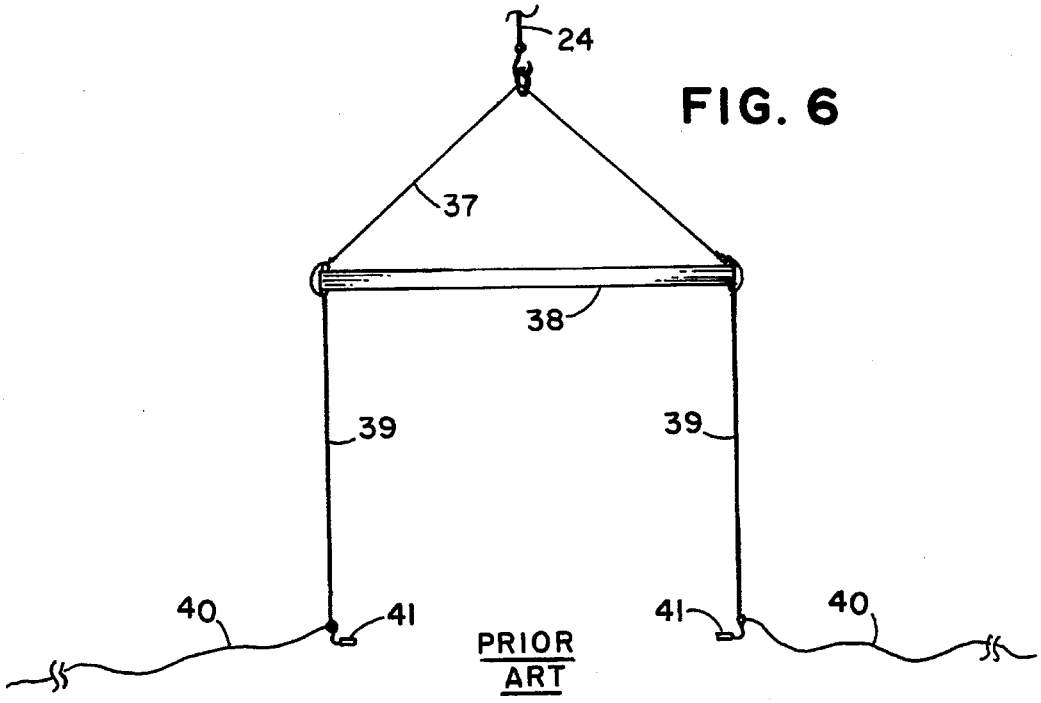
FIG. 6 PRIOR ART
FIG. 6 is a simplified representation of a prior art pipe handler used for off-loading and handling large pipes.

Turning now to FIG. 5, a typical pipe 42 is shown being lifted by the pipe handler 10 of the invention. Winch 20 has been operated to spread lift arms 16. The crane operator has controlled winch 20 to swing lift arms 16 open and workers at each end of pipe 42 have engaged lifting hook 19 in the respective ends thereof. The crane operator will lift the pipe and deposit it at the required location with no further manpower required. The lifting shoes 19 are released by providing slack and swinging lifting arms 16 outward, preparatory for moving to the next pipe.

As will now be recognized, a method of safely handling large pipes and the like has been disclosed in which the following steps are illustrative thereof:

1. Providing a spreader bar suspended horizontally by a crane;

2. Hingedly attaching a lift arm tube to each end of the spreader bar, each tube having a lifting shoe at its distal end;

3. Swinging the lift arm tubes outwardly;

4. Swinging the spreader bar over a pipe to thereby position a lifting hook adjacent respective ends of the pipe;

5. Controllably releasing the lift arm tubes to swing the lifting hooks into the respective ends of the pipe; and

6. Lifting the spreader bar with the crane and depositing the pipe at a new location.

An apparatus and method of safely handling large pipes without damage thereto, and without injury to personnel, has been disclosed. The elements of the invention have been shown in exemplary form; however, the invention is not to be limited to the specific arrangements shown as many variations can be made thereto without departing from the spirit and scope of the invention.

We claim:

1. A pipe handler for suspension from a crane comprising:

a) a horizontally disposed spreader bar having a support cable;

b) a pair of lifting arms, a first arm thereof pivotally dependent from a first end of said spreader bar, and a second arm thereof pivotally dependent from a second end of said spreader arm;

c) a pair of lifting shoes, a first one of said lifting shoes pivotally attached to a distal end of said first arm, and a second lifting shoe thereof pivotally attached to a distal end of said second arm; and d) a winch assembly having a pair of cable drums, a first cable on a first one of said drums connected to said first lifting arm and adapted to swing said first lifting arm outward, and a second cable on a second one of said drums, said second cable connected to said second lifting arm and adapted to swing said second lifting arm outward;

e) whereby said spreader bar and said pair of lifting arms are positionable by a crane over a pipe to be handled, and said lifting arms are thereafter movable by said winch assembly to engage respective ends of said pipe with said lifting shoes for lifting and moving thereof.

2. The pipe handler as defined in claim 1 in which said winch assembly includes:

a) an electric motor for driving said drums and means for controlling said motor from a crane.

3. The pipe handler as defined in claim 1 in which each of said lifting shoes include arcuate shoe portions thereof.

4. The pipe handler as defined in claim 3 in which said arcuate lifting shoe portions have an outer curvature to match the inner curvature of a pipe to be handled.

5. The pipe handler as defined in claim 3 in which said arcuate lifting shoe portions are changeable for matching the inner curvature of a pipe to be handled.

6. Pipe handling apparatus for suspension from a crane comprising:

a) a horizontal spreader bar having a remotely controlled winch mounted thereon, said winch including a pair of cable drums, and first and second cables disposed on said drums;

b) a first pulley arm extending from a first end of said spreader bar having a first pulley attached thereto, and a second pulley bar extending from a second end of said spreader bar having a second pulley attached thereto;

c) a pair of lifting arms, a first of said lifting arms pivotally suspended from said first end of said spreader bar, and a second of said lifting arms pivotally suspended from said second end of said spreader bar;

d) a first bracket attached along said first lifting arm and extending outwardly therefrom, and a second bracket attached along said second lifting arm and extending outwardly therefrom, wherein said first cable is passed over said first pulley and attached to a distal end of said first bracket, and said second cable is passed over said second pulley and attached to a distal end of said second bracket; and e) a first lifting shoe pivotally attached to a distal end of said first lifting arm, and a second lifting shoe pivotally attached to a distal end of said second lifting arm;

f) whereby operation of said winch in a first direction causes said first and second cables to swing said lifting arms outwardly, and operation of said winch in a second direction causes said first and second cables to close said lifting arms to thereby engage ends of the pipe to be supported by said first and second lifting shoes.

7. A method of safely lifting, moving, and depositing a pipe comprising the steps of:

a) providing a horizontally disposed spreader bar;

b) providing a double-drum winch, the winch having a cable on each drum thereof, on the spreader bar;

b) suspending the spreader bar from a crane;

c) hingedly attaching a proximal end of one of a pair of lift arm tubes to each end of the spreader bar, each tube having a lifting shoe at a distal end thereof, d) attaching a drum cable toward the distal end of each lift arm tube;

e) operating the winch to swing the lift arm tubes sufficiently outward and over a pipe to be lifted thereby controlling the lift arm tubes to cause the lifting shoes to engage the respective ends of the pipe to be lifted; and g) lifting the spreader arm and the pipe with the crane, moving the pipe to a desired location, and depositing the pipe.

* * * * *